US008479452B2

(12) United States Patent
Page

(10) Patent No.: US 8,479,452 B2
(45) Date of Patent: Jul. 9, 2013

(54) TRANSPORTABLE INFLATABLE WORKSTATION

(76) Inventor: George Page, Salford (GB)

( * ) Notice: Subject to any disclaimer, the term of this patent is extended or adjusted under 35 U.S.C. 154(b) by 627 days.

(21) Appl. No.: 12/438,261

(22) PCT Filed: Aug. 22, 2007

(86) PCT No.: PCT/GB2007/050504

§ 371 (c)(1),
(2), (4) Date: Sep. 22, 2009

(87) PCT Pub. No.: WO2008/023206

PCT Pub. Date: Feb. 28, 2008

(65) Prior Publication Data

US 2010/0083586 A1 Apr. 8, 2010

(30) Foreign Application Priority Data

Aug. 22, 2006 (GB) ..... 0616634.2

(51) Int. Cl.

| | |
|---|---|
| ***E04B 1/34*** | (2006.01) |
| ***E04G 11/04*** | (2006.01) |
| ***E04H 15/20*** | (2006.01) |
| ***E04H 15/22*** | (2006.01) |
| *E04H 15/18* | (2006.01) |
| *E04B 7/14* | (2006.01) |
| *E04B 1/32* | (2006.01) |

(52) U.S. Cl.

CPC ..... *E04H 15/22* (2013.01); *E04H 15/20* (2013.01); *E04H 2015/203* (2013.01); *E04H 15/18* (2013.01); *E04B 7/14* (2013.01); *E04B 2001/3252* (2013.01)

USPC ..... 52/2.23; 52/2.17; 52/63

(58) Field of Classification Search

USPC ..... 52/2.11, 2.13, 2.14, 2.17, 2.21, 2.22, 52/2.24, 2.25, 2.23, 63; 472/134

See application file for complete search history.

(56) References Cited

U.S. PATENT DOCUMENTS 2,863,467 A * 12/1958 Hearell ..... 52/2.17
3,857,209 A 12/1974 Milliken (Continued)

FOREIGN PATENT DOCUMENTS

| | | |
|---|---|---|
| EP | 0118343 | 9/1984 |
| WO | 02/36904 | 5/2002 |

OTHER PUBLICATIONS

PCT International Search Report, PCT/GB2007/050504, European Patent Office, Feb. 19, 2008.

*Primary Examiner* — William Gilbert
*Assistant Examiner* — Theodore Adamos
(74) *Attorney, Agent, or Firm* — Andrus, Sceales, Starke & Sawall, LLP

(57) ABSTRACT

A transportable workstation suitable for providing a closed environment for spraying a vehicle has a base sheet and a cover sheet connected to the edges of the base sheet and at least partially releasable therefrom. First and second further sheets are provided within the cover sheet and are also releasably connected to the base sheet in order to define first and second end chambers, between which is formed a work chamber. An air blower drives air into the first end chamber and passageways allow the flow of air from the first end chamber into the work chamber and from there into the second end chamber before release to the ambient. A filter is associated with the air flow through the second end chamber to prevent pollutants entering the atmosphere. Closable access openings are provided in the first end chamber, respectively from the exterior and to the work chamber.

24 Claims, 4 Drawing Sheets

U.S. PATENT DOCUMENTS

| | | | | | |
|---|---|---|---|---|---|
| 4,103,369 | A * | 8/1978 | Riordan | 52/2.14 |
| 4,707,953 | A * | 11/1987 | Anderson et al. | 52/63 |
| 5,331,991 | A * | 7/1994 | Nilsson | 135/93 |
| 5,537,784 | A * | 7/1996 | Baldwin | 52/2.17 |
| 5,615,521 | A * | 4/1997 | Simerka | 52/2.22 |
| 6,119,408 | A * | 9/2000 | Page | 52/2.23 |
| 6,192,633 | B1 * | 2/2001 | Hilbert | 52/2.18 |
| 6,266,927 | B1 * | 7/2001 | Leslie | 52/2.17 |
| 6,438,900 | B1 | 8/2002 | Page | |
| 6,623,351 | B2 * | 9/2003 | Brown | 454/187 |
| 6,875,119 | B2 * | 4/2005 | Murphy et al. | 472/134 |
| 8,079,182 | B1 * | 12/2011 | Higgins | 52/2.11 |
| 2002/0083653 | A1 * | 7/2002 | Hilbert | 52/2.17 |

* cited by examiner

TRANSPORTABLE INFLATABLE WORKSTATION

CROSS REFERENCE TO RELATED APPLICATION

The present application is the U.S. national stage application of International Application PCT/GB2007/050504, filed Aug. 22, 2007, which international application was published on Feb. 28, 2008 as International Publication WO 2008/023206. The International Application claims priority of British Patent Application 0616634.2, filed Aug. 22, 2006.

This invention relates to a transportable inflatable workstation—that is to say, apparatus which may provide an onsite work chamber, for the performance of various activities, and which is inflatable for use and deflatable for transport.

The cosmetic and minor damage repair of motor vehicles is frequently undertaken in open air, by operators skilled in spraying only a small damaged area of a vehicle, in such a way that the repair is essentially invisible. The operator will normally use an airbrush to spray the paint and even though the area covered by the paint from an airbrush can be tightly controlled, inevitably some of the spray and the solvent for the paint escapes to the environment. If the weather is inclement, the operator may tape sheets to the vehicle being repaired and also use poles to hold the sheet away from the surface to which the paint is applied, but the repair is still performed in the open air. Such repairs can be undertaken relatively cheaply as compared to performing the required work in a more conventional manner, involving extensive preparation to the area to be repaired, which possibly may even include replacement of damaged panels, and then re-finishing the vehicle in a spray booth. At least in part, open-air repairs are cheaper because the operator may work on the vehicle wherever it happens to be, rather than having to take the vehicle to a fixed workshop.

New regulations coming into operation will control the commercial release of solvents to the ambient atmosphere, as well as the release of other materials such as sprayed paint particles. When these regulations are in place, no longer will it be possible for repairs as discussed above to be performed in the open air. Rather, the commercial repair of vehicles will have to take place in a closed environment, with the discharge from that environment being filtered to prevent the release of substances to the atmosphere. These regulations will therefore have a serious impact on the undertaking of minor repair work on motor vehicles by peripatetic operators who work in the open air or under minimal protection provided by sheeting taped to the vehicle.

It is a principal aim of the present invention to provide means whereby a closed working environment may be provided for the performance of work which otherwise would be likely to release pollutants such as paint particles and solvents to the ambient. This is achieved by furnishing a transportable inflatable workstation including a work chamber within which the work may be performed, without risk of the release of pollutants to the ambient.

Accordingly, therefore, this invention provides a transportable inflatable workstation comprising a base sheet, a cover sheet adapted to be connected to the base sheet and at least partially releasable therefrom, first and second further sheets also adapted to be connected to the base sheet and at least partially releasable therefrom, the further sheets defining in conjunction with the base sheet first and second end chambers disposed at opposed ends of the base sheet whereby a work chamber is defined by the base sheet and the cover sheet between the end chambers, air blower means arranged to drive air into the first end chamber, air passageways to permit air to flow from the first end chamber into the work chamber, from the work chamber into the second end chamber, and from the second end chamber to the exterior thereby to inflate the work chamber and the two end chambers, the first end chamber being provided with a first closable access opening to the exterior and a second closable access opening to the work chamber, and at least one of the passageways associated with the second end chamber being provided with a filter to prevent pollutants leaving the second end chamber to the exterior.

It will be appreciated that the workstation of this invention, if appropriately dimensioned, is particularly suitable for undertaking minor repair work to motor vehicles, and especially repair work involving spray paints and the like. The workstation includes a work chamber which communicates with a first end chamber and a separate second end chamber, and when in use air is driven into the first end chamber, then to flow from that first end chamber into the work chamber, and from the work chamber into the second end chamber, from where air is released to the ambient. An air blower assembly is arranged to drive air into the first end chamber and thus inflate that chamber; the air flowing into the work chamber then inflates that chamber, and the air flowing from the work chamber to the second end chamber inflates that chamber, as well. Air flowing through the second end chamber is filtered, preferably on leaving that chamber but possibly on entering that chamber, so as to minimise the likelihood of the escape of pollutants.

Access to the work chamber is through the first end chamber, within which the air pressure is the highest. Releasing the first access opening of the first end chamber allows air to flow from the first end chamber to the ambient atmosphere, but there will be no contamination of that air by operations which may be performed in the work chamber. After closing that first access opening and releasing the second access opening increases the airflow from the first end chamber to the work chamber but does not allow the escape of contaminated air to the ambient. So long as the air blower assembly continues to operate, all airflow from the work chamber will be to the second end chamber, within which one or more filters may be provided to remove from the airflow substantially all contaminants, before the air is released to the ambient atmosphere.

In a preferred form of this invention, the base sheet is generally rectangular in shape, and the cover sheet defines opposed side walls, opposed end walls and a top wall of the work chamber. The lower edges of the side and end walls are releasably connected to the base sheet by fasteners which extend along the sides of the base sheet and transversely thereacross at dispositions spaced from the ends of the base sheet. For this embodiment, each further sheet may comprise opposed side walls, an end wall and a top wall, the side walls and top wall being attached to the cover sheet side walls and top wall respectively. Then, the lower edges of the side and end walls of the further sheet may be releasably connected to the base sheet by further fasteners which extend along the sides of the base sheet from the cover sheet to the adjacent end of the base sheet and along the end of the base sheet.

Preferably, the respective edges of the side and top walls of the further sheets are permanently connected to the side and top walls of the cover sheet. The releasable connections of the lower edges to the base sheet preferably comprise zip fasteners the two components of which extend respectively along the lower edges of the side and end walls, and along the edges of the base sheet and transversely thereacross. In this way, the three chambers of the workstation may be defined by a single sheet comprising the cover sheet and two further sheets, which may readily be assembled to the base sheet following the location of a work-piece thereon, whereafter operation of the air blower assembly inflates all three chambers thereafter permitting the performance of whatever operation is required on the work-piece.

The work chamber and also the end chambers may be provided by a different configuration of cover sheet and further sheets. In this different configuration, the cover sheet defines opposed side walls, opposed end walls and a top wall, the lower edges of the side and end walls being releasably connected to the edges of the base sheet. Then, each further sheet may extend transversely between the opposed side walls of the cover sheet at locations spaced inwardly from the cover sheet end walls, the lower edges of the further sheets being releasably connected to the base sheet, thereby to define the first and second end chambers. Thus, each further sheet may define just a single wall and so is essentially planar, when the workstation is inflated.

Preferably, the side and top edges of each further sheet are permanently connected to the opposed side walls and top wall of the cover sheet. As with the preferred configuration, the fasteners may comprise zip fasteners the two components of which extend respectively along the lower edges of the side and end walls, and along the edges of the base sheet as well as transversely thereacross, for connection to the further sheets. Conveniently, there are three zip fasteners, one associated with the lower edges of the side and end walls of the cover sheet and the perimeter of the base sheet, and the other two zip fasteners being associated one with the lower edge of each further sheet respectively. Fasteners similar to zip-fasteners may be employed, which give a connection along the length of the components to be connected, such as hook-and-loop strip fasteners.

For convenience, each access opening in the first end chamber is defined by a generally vertically-extending slit in a wall of the end chamber, the adjacent edges of the slit being releasably connected together for closing of the opening. Preferably, a zip fastener is provided to connect together those adjacent edges. In this way, access may easily be gained to the work chamber, by releasing the zip fastener of the access opening in an external wall of the first end chamber, entering the first end chamber and then closing that opening. Then, the access opening in the wall between the first end chamber and the work chamber may be opened by releasing its zip fastener, and after the work chamber has been entered, that zip fastener may be closed once more to permit normal operation of the workstation. During this, no contaminated air will escape to the ambient, since the pressure in the first end chamber is higher than in the work chamber where contamination may be generated.

The passageway from the first end chamber to the work chamber may comprise an aperture through the wall separating the first end chamber from the work chamber. A filter may be fitted to said aperture, to separate particles from the airflow into the work chamber, so as to ensure that the air entering the work chamber is clean and will not spoil an operation being performed therein, such as the spraying of a vehicle panel.

As an alternative to the above, the passageway may comprise a duct leading from the first end chamber along the underside of the top wall of the cover sheet, which duct is provided with at least one downwardly-directed outlet opening, into the work chamber. A filter may be associated with the duct, to separate particles form the airflow into the work chamber, as with the arrangement discussed above, and in this case the filter is preferably fitted to the inlet to or the outlet from said duct.

With either passageway, means may be provided to control the flow of air from the first end chamber to the work chamber. In the first arrangement, a flap may be secured partially across the aperture to vary the effective area thereof. With the arrangement using a duct, a flap may be provided to adjust the effective area of at least one of the inlet to the duct, the cross-sectional area of the duct and the effective area of the outlet openings from the duct. In either case, control of the airflow into the work chamber may be achieved.

The passageway from the work chamber to the second end chamber may comprise a simple opening through the wall separating the work chamber from the second end chamber. A filter may be fitted to said opening, to filter contaminants from the airflow into the work chamber. Also, the passageway from the second end chamber to the exterior may comprise a further opening through a side or end wall of the second end chamber and in this case, a filter may be fitted to said further opening, to filter contaminants from the airflow into the work chamber.

For the preferred arrangement as just discussed above, one of said filters may comprise a particle filter, for separating from the airflow particles such as of sprayed paint, and the other of said filters may comprise an activated carbon filter for separating solvents from the airflow, such as are used with paints.

The air blower assembly conveniently comprises an electrically-driven air blower mounted with the first end chamber and drawing air from the exterior. Preferably, an air conditioning unit is associated with the blower, in order to remove excess moisture from the airflow and to heat or cool that airflow, as required.

By way of example only, one specific embodiment of transportable inflatable workstation of this invention and intended for accommodating a motor vehicle for the purpose of performing operations thereon such as the repair of minor cosmetic damage will now be described in detail, reference being made to the accompanying drawings in which.

Figure 1:
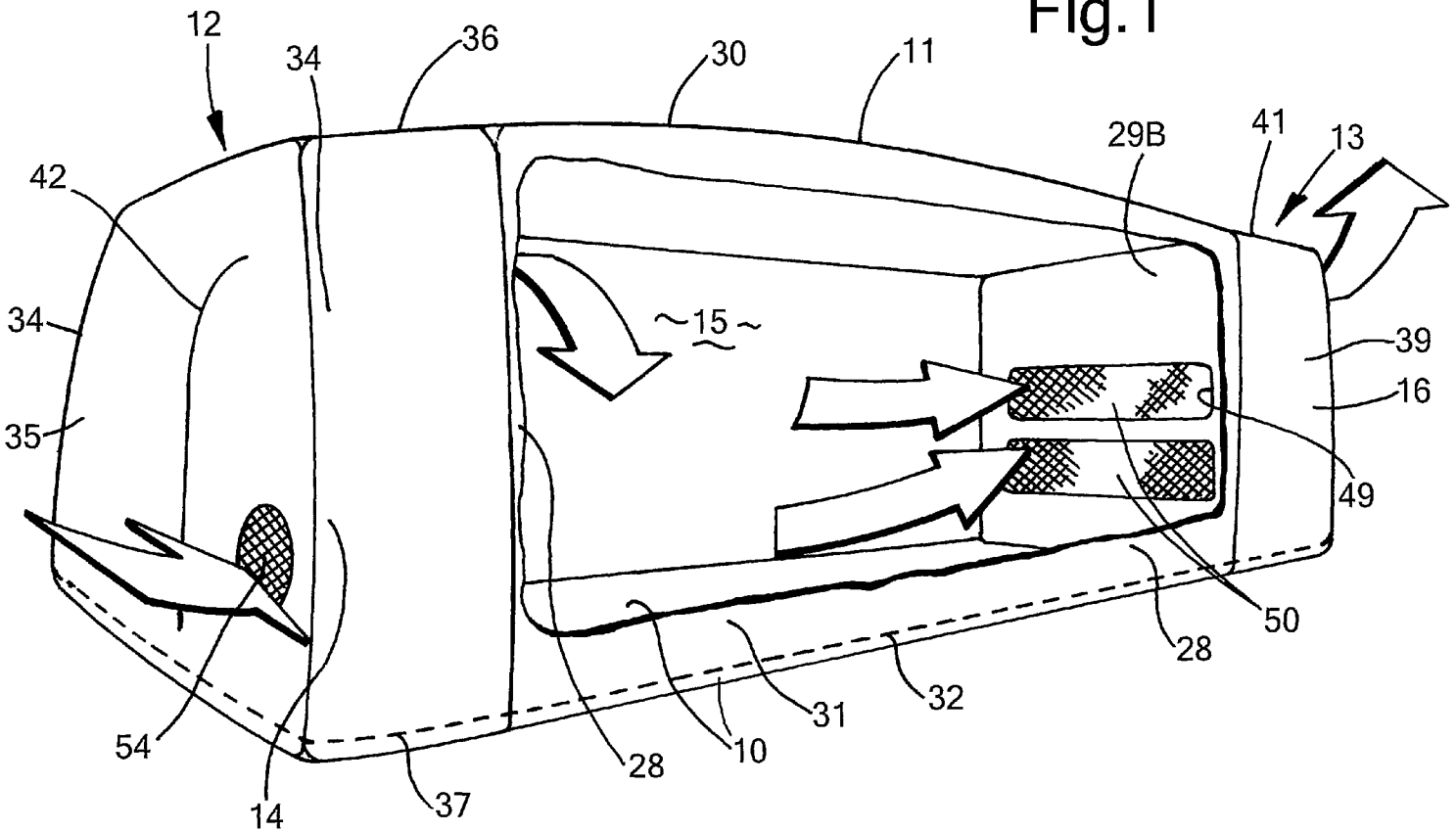
FIG. 1 is a diagrammatic perspective view of a first embodiment of workstation, from one end thereof and with parts cut away for clarity.
Figure 2:
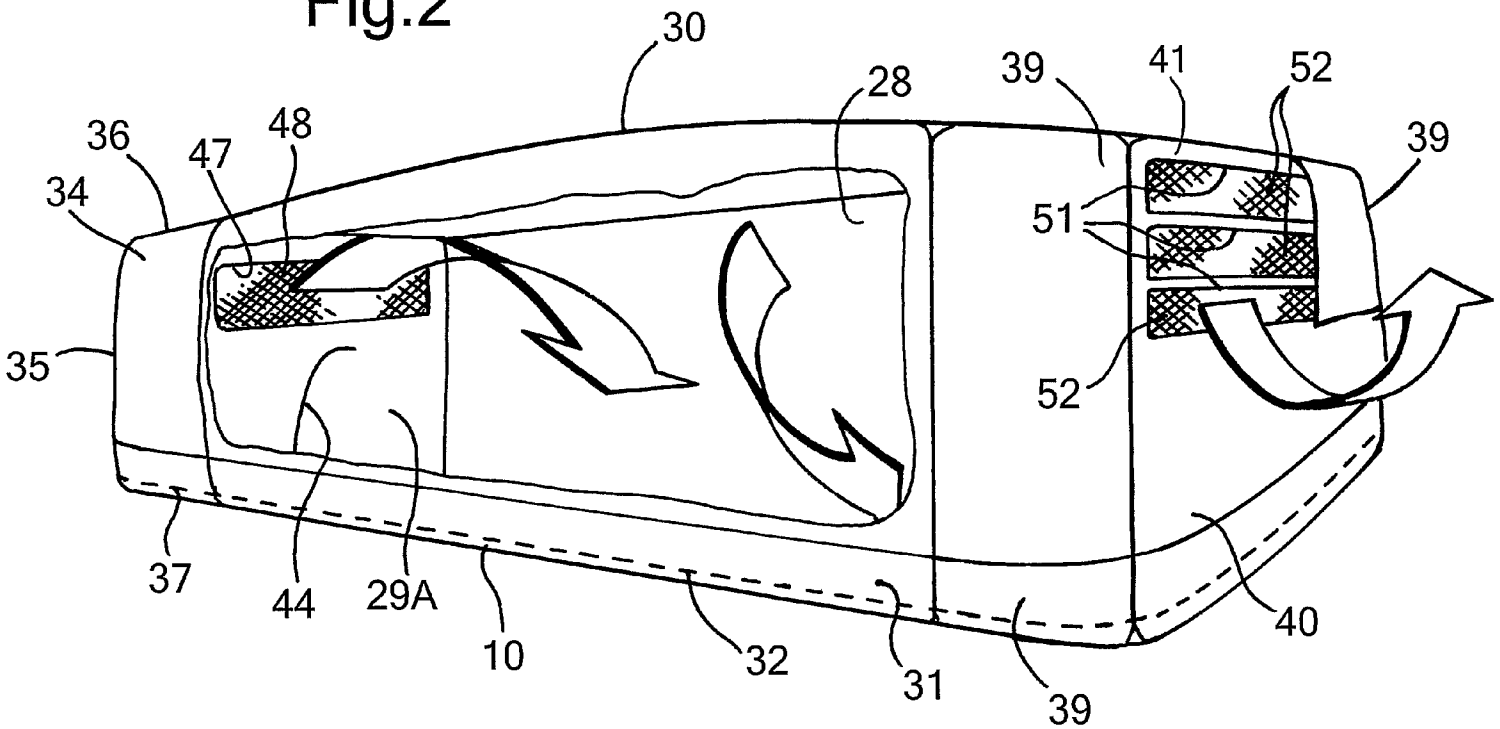
FIG. 2 is a similar view of the first embodiment, but from the other end thereof.
Figure 3:
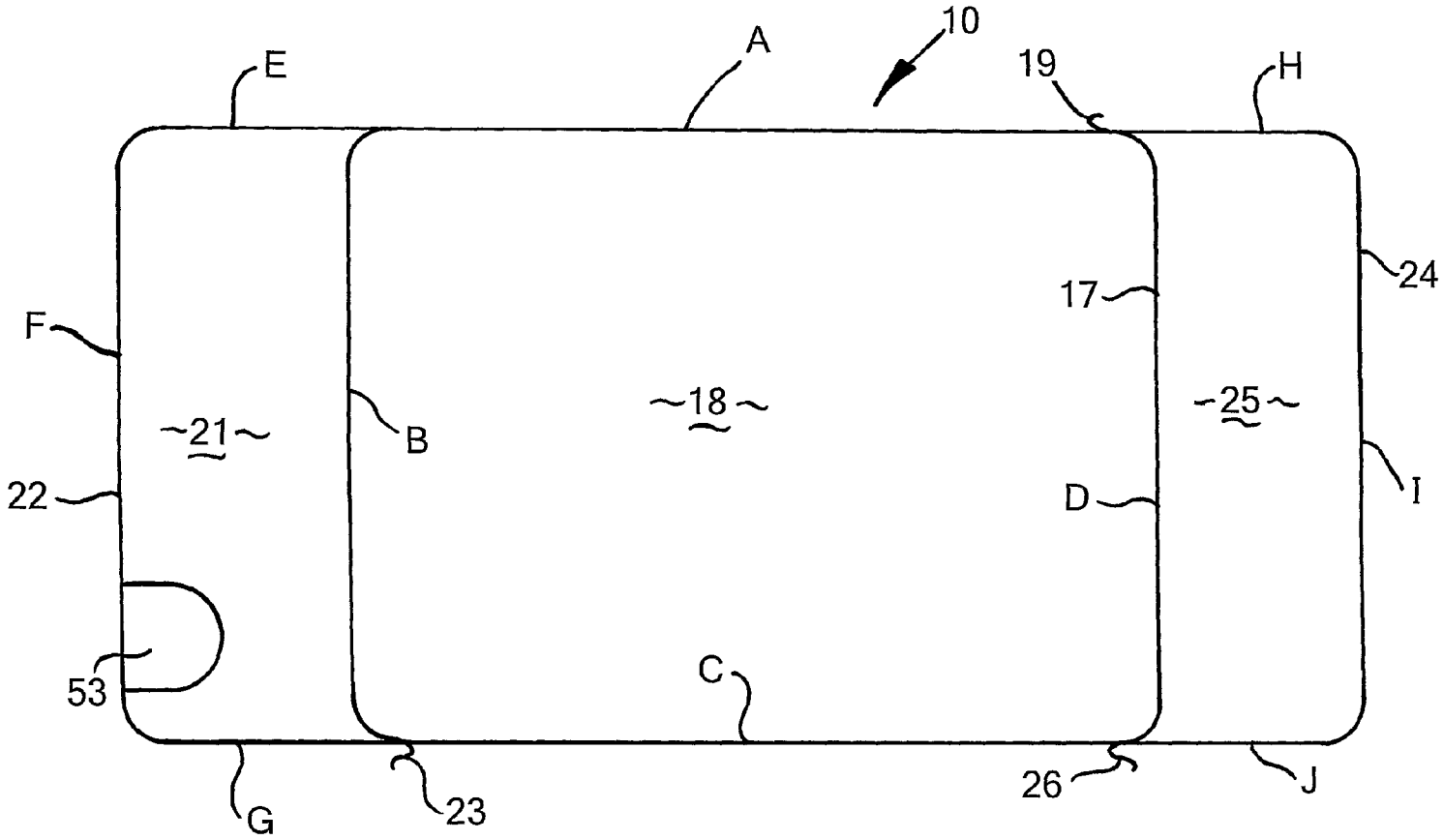
FIG. 3 is a plan view on the base sheet of the embodiment of FIGS. 1 and 2.

Referring initially to FIGS. 1 to 3, it can be seen that the first embodiment of workstation of this invention comprises a base sheet 10, a cover sheet 11 and first and second further sheets 12 and 13, connected together and to the base sheet 10 so as to provide a first end chamber 14, a work chamber 15 and a second end chamber 16. The base sheet 10, cover sheet 11 and first and second further sheets 12,13 are all of a flexible plastics material and as shown in the drawings, transparent panels may be provided in those sheets (but not the base sheet) for the convenience of operators working within the work chamber.

The base sheet 10 is of generally rectangular shape, as best seen in FIG. 3, and is provided with one part 17 of a continuous elongate first zip fastener around four sides A,B,C,D of a rectangular central area 18, the part 17 of the zip fastener including a tail 19 free of the base sheet 10. End area 21, defined between side B of the central area 18 and the adjacent end of the base sheet has one part 22 of a second zip fastener extending around sides E,F,G of that end area 21, and again a tail 23 of that part 22 is free of the base sheet. In a similar way, one part 24 of a third zip fastener extends around sides H,I,J of end area 25 disposed between side D of the central area and the adjacent end of the base sheet. That one part 24 also has a tail 26 free of the base sheet.

The cover sheet 11 has a pair of opposed side walls 28, a pair of opposed end walls 29A and 29B and a top wall 30, each of generally rectangular shape. The lower edges 31 of the pairs of side walls and end walls have the other part 32 of the first zip fastener secured thereto, such that the first zip fastener when closed serves to secure the opposed pairs of side and end walls to the sides A,B,C,D of the base sheet 10.

The first further sheet 12 has an pair of opposed side walls 34, an end wall 35 and a top wall 36, with the edges of those walls adjacent the cover sheet 11 permanently secured thereto. The other part 37 of the second zip fastener is secured to the lower edges of the side walls 34 and end wall 35, such that the second zip fastener when closed serves to secure the side and end walls of the first further sheet 12 to the base sheet 10. In this way, the first end chamber 14 is formed, to one end of the work chamber 15.

In a similar way, the second further sheet 13 has a pair of opposed side walls 39, an end wall 40 and a top wall 41 and the lower edges of the side and end walls are provided with the upper part of the third zip fastener, whereby the second further sheet may be secured to the base sheet 10 and so define the second end chamber 16.

A first access opening is defined by a slit 42 is formed in end wall 35 of the first further sheet 12, which slit is normally closed by a zip fastener but which when opened allows access to the interior of the first end chamber 14. In a similar way, the end wall 29A of the cover sheet 11 adjacent the first end chamber also has a corresponding slit 44 (FIG. 2) defining a second access opening, normally closed by a zip fastener but which when opened gives access from the first end chamber 14 to the work chamber 15.

An aperture 47 is formed through the end wall 29A of the cover sheet 11, a particle filter 48 being fitted over that aperture so that air passing from the first end chamber 14 to the work chamber is filtered thereby. The opposed end wall 29B has a pair of openings 49 therein, each of which is fitted with an extraction filter 50 in order to remove particles from the airflow therethrough. The end wall 40 of the second further sheet 13 has three openings 51 therein, each of which is fitted with an activated carbon filter 52, in order to remove entrained solvents in the airflow through those filters.

Mounted within the first end chamber 14 is an electrically-driven air blower assembly 53, communicating with the exterior through a port 54 fitted with a suitable filter. Included within the air blower assembly (but not shown) is an air conditioning unit, to adjust the temperature and humidity of the airflow from the assembly 53, into the first end chamber 14.

Means to control the flow of air into the work chamber from the first end chamber may comprise a flap 55 (FIG. 2) which can be secured partially to cover particle filter 48, mounted in aperture 47 in the end wall 29A. Suitable means may be provided to secure the flap 55 covering the aperture 47 to the required extent so as to obtain a sufficient airflow.

In use, the cover sheet 11 and first and second further sheets 12,13 are removed from the base sheet 10 by releasing the three zip fasteners extending around sides A to D, E to G and H to J. The vehicle is then driven on to the central area 18 but perhaps displaced to one side or end thereof, depending upon the part of the vehicle on which operations are to be performed. The cover sheet 11 is thrown over the vehicle and the first zip fastener closed so as to secure the opposed side walls 28 and opposed end walls 29A,29B to the base sheet 10 along sides A to D. The second and third zip fasteners are then closed, to secure the lower edges of the first and second further sheets 12,13 to the base sheet, respectively along sides E to G and H to J.

Once the zip fasteners have been fully closed, the air blower assembly 53 is operated, to draw air through port 54 and into the first end chamber 14. From there, air flows through the filter 48 in aperture 47, to inflate the work chamber 15. As the pressure rises in the work chamber 15, air flows into the second end chamber 16 through the extraction filters in openings 51 and thus inflates that second end chamber as well. As the pressure rises in the second end chamber 16, air will start to flow out of the second end chamber, through the activated carbon filters 52. There will thus be a pressure gradient within the workstation, with the highest pressure in the first end chamber and the lowest pressure in the second end chamber.

Access is gained to the work chamber 15 through the access openings in the first end chamber, opening those one at a time. In this way, opening of the zip fastener associated with the first slit 42 will allow air to escape to the ambient from the first end chamber 14 but that air will not have been contaminated by any operations being performed with the work chamber 15.

Opening the zip fastener associated with the second slit 44, communicating with the work chamber, will merely increase the airflow into the work chamber. There will be no escape of contaminated air as any air already contaminated within the work chamber cannot flow back into the first end chamber, which has a higher internal pressure.

When operations are being performed within the work chamber 15, such as the spraying of a vehicle panel, particles of spray will be entrained in the airflow from the work chamber into the second end chamber but will be trapped by the extraction filters 50 in the openings 49, as the air enters the second end chamber 16. Entrained solvents which may pass through those filters will be trapped by the activated carbon filters 52 in the openings 51, such that the air released to the ambient will be essentially clean.

Figure 4:
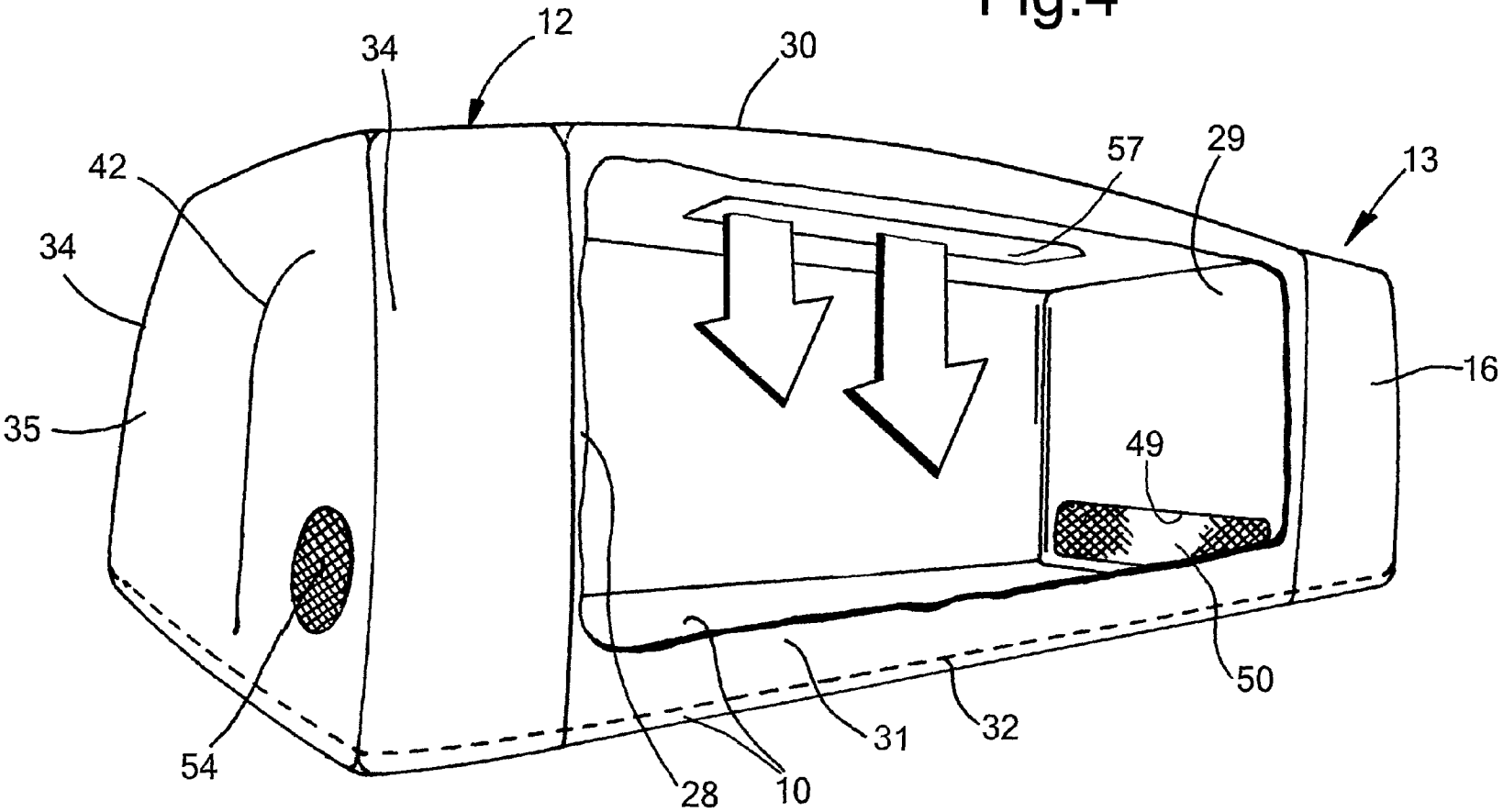
FIG. 4 is a diagrammatic perspective view of a second embodiment of workstation from one end thereof, and again with parts cut away for clarity.

The embodiment of FIG. 4 differs from that of FIGS. 2 and 3 in that a double-skinned top wall 30 is provided for the cover sheet 11, the inner skin of which has a downwardly facing opening 57. The space between the two skins communicates with the first end chamber through an opening in the end wall of the cover sheet and which is fitted with a particle filter (not shown) whereby air may flow from that first end chamber into the space between the skins and then downwardly into the work chamber, through opening 57. For this arrangement, the aperture 47 provided in end wall 29A in the first embodiment is omitted. Further, the outlet from the work chamber 15 to the second end chamber 16 is through an opening 51 disposed relatively low down in the wall of that end chamber, to maximise the downward flow of the air into the work chamber.

In other respects, the embodiment of FIG. 4 corresponds to that of FIGS. 1 to 3. Like parts are given like reference characters and will not be discussed in detail again, here.

The invention claimed is:

1. A transportable inflatable workstation comprising a base sheet, a cover sheet adapted to be connected to the base sheet and at least partially releasable therefrom, first and second further sheets also adapted to be connected to the base sheet and at least partially releasable therefrom, the base sheet and further sheets defining first and second end chambers disposed at opposed ends of the base sheet and a work chamber between the end chambers, air blower means arranged to drive air into the first end chamber, air passageways to permit air to flow from the first end chamber into the work chamber, from the work chamber into the second end chamber, and from the second end chamber externally of the workstation thereby to inflate the work chamber and the two end chambers, the first end chamber being provided with a first closable access opening from externally thereof and a second closable access opening within a wall separating the first end chamber from the work chamber, and the air passageways associated with the second end chamber comprising an opening within a wall separating the work chamber from the second end chamber being provided with a filter and an opening through a side or end wall of the second end chamber being provided with a filter to prevent pollutants leaving the second end chamber to the externally thereof, whereby air travels in one direction from the first end chamber to the second end chamber and externally of the workstation while in use.

2. A workstation as claimed in claim 1, wherein the base sheet is generally rectangular in shape, and the cover sheet defines opposed side walls, opposed end walls and a top wall of the work chamber, and there are fasteners releasably connection the lower edges of the side and end walls to the base sheet, said fasteners extending along the sides of the base sheet and transversely thereacross at dispositions spaced from the ends of the base sheet.

3. A workstation as claimed in claim 2, wherein each further sheet comprises opposed side walls, an end wall and a top wall, the side walls and top wall being attached to the cover sheet side walls and top wall respectively, and the lower edges of the side and end walls of the further sheet being releasably connected to the base sheet by further fasteners which extend along the sides of the base sheet from the cover sheet to the adjacent end of the base sheet and along the end of the base sheet.

4. A workstation as claimed in claim 3, wherein the respective edges of the side and top walls of the further sheets are permanently connected to the side and top walls of the cover sheet.

5. A workstation as claimed in claim 3, wherein the fasteners comprise zip fasteners having two components extending respectively along the lower edges of the side and end walls, and along the edges of the base sheet and transversely thereacross.

6. A workstation as claimed in claim 5, wherein there are three zip fasteners, one zip fastener being associated with the lower edges of the side and end walls of the cover sheet, the second zip fastener being associated with the lower edges of the side and end walls of the first further sheet, and the third zip fastener being associated with the side and end walls of the second further sheet.

7. A workstation as claimed in claim 1, wherein the cover sheet defines opposed side walls, opposed end walls and a top wall, the lower edges of the side and end walls being releasably connected to the edges of the base sheet.

8. A workstation as claimed in claim 7, wherein each further sheet extends transversely between the opposed side walls of the cover sheet at locations spaced inwardly from the cover sheet end walls and the lower edges of the further sheets being releasably connected to the base sheet, thereby to define the first and second end chambers.

9. A workstation as claimed in claim 8, wherein the side and top edges of each further sheet are permanently connected to the opposed side walls and top wall of the cover sheet.

10. A workstation as claimed in claim 8, wherein there are zip fasteners having two components to releasably connect the further sheets to the base sheet, the two components extending respectively along the lower edges of the side and end walls, and along the edges of the base sheet and transversely thereacross.

11. A workstation as claimed in claim 10, wherein there are first, second and third zip fasteners, the first zip fastener being associated with the lower edges of the side and end walls of the cover sheet and the perimeter of the base sheet, the second zip fastener being associated with the lower edge of the first further sheet, and the third zip fastener being associated with the lower edge of the second further sheet.

12. A workstation as claimed in claim 1, wherein each access opening in the first end chamber is defined by generally vertically-extending slit, the adjacent edges of the slit being releasably connected together.

13. A workstation as claimed in claim 12, wherein a zip fastener is employed to secure together the adjacent edges of each access opening slit.

14. A workstation as claimed in claim 1, wherein the passageway from the first end chamber to the work chamber comprises an aperture through the wall separating the first end chamber from the work chamber.

15. A workstation as claimed in claim 14, wherein a filter is fitted to said aperture, to separate particles from the airflow into the work chamber.

16. A workstation as claimed in claim 1, wherein the effective area of the aperture is adjustable thereby to permit control of the airflow therethrough.

17. A workstation as claimed in claim 1, wherein one of the air passageways comprises a duct leading from the first end chamber along the underside of the top wall of the cover sheet and provided with downwardly-directed outlet openings.

18. A workstation as claimed in claim 17, wherein a filter is associated with the duct, to separate particles from the airflow into the work chamber.

19. A workstation as claimed in claim 18, wherein said filter is fitted to an inlet to said duct.

20. A workstation as claimed in claim 17, wherein means are provided to adjust an effective area of at least one of an inlet to the duct, a cross-sectional area of the duct and an effective area of outlet openings from the duct, thereby to permit control of the airflow into the work chamber.

21. A workstation as claimed in claim 1, wherein one of said filters comprises a particle filter and the other of said filters comprises an activated carbon filter to separate solvents from the airflow.

22. A workstation as claimed in claim 1, wherein the air blower means comprises an electrically-driven air blower mounted within the first end chamber and drawing air from the exterior.

23. A workstation as claimed in claim 1, wherein an air-conditioning unit is associated with said air blower.

24. A workstation as claimed in claim 1, wherein the base sheet, cover sheet and further sheets are all of a plastics material and at least some of the walls thereof are provided with transparent panels.

* * * * *